United States Patent [19]

Harwood

[11] Patent Number: 4,487,089

[45] Date of Patent: Dec. 11, 1984

[54] MINIATURE ADJUSTABLE POTENTIOMETER CLUTCH

[75] Inventor: Craig E. Harwood, Cedar Rapids, Iowa

[73] Assignee: Rockwell International Corporation, El Segundo, Calif.

[21] Appl. No.: 332,139

[22] Filed: Dec. 18, 1981

[51] Int. Cl.[3] ..... G05G 5/06

[52] U.S. Cl. ..... 74/531; 74/553

[58] Field of Search ..... 74/527, 531, 504, 553, 74/10.41; 403/373; 16/DIG. 30, 112, 121, 123

[56] References Cited

U.S. PATENT DOCUMENTS

| | | | |
|---|---|---|---|
| 2,509,058 | 5/1950 | Haury | 74/531 X |
| 2,560,015 | 7/1951 | Waldron | 74/531 |
| 2,567,571 | 9/1951 | Merriman | 74/531 X |
| 2,660,904 | 12/1953 | Hilsinger, Jr. | 74/531 X |
| 2,836,989 | 6/1958 | Schultz | 74/531 X |
| 2,909,934 | 10/1959 | Meadows | 74/10.41 X |
| 3,053,110 | 9/1962 | Shalek | 74/531 X |
| 3,987,687 | 10/1976 | Bland et al. | 74/531 |
| 4,036,079 | 7/1977 | Pratt | 74/531 |
| 4,201,096 | 5/1980 | Morrison et al. | 74/531 |

*Primary Examiner*—Stephen J. Novosad
*Assistant Examiner*—Frank H. McKenzie, Jr.
*Attorney, Agent, or Firm*—George A. Montanye; H. Fredrick Hamann

[57] ABSTRACT

An adjustable clutch mechanism is disclosed which may be removably mounted to a shaft to selectively vary the torque required to turn the shaft. The clutch mechanism includes a threaded, flanged bushing which receives a pair of friction washers and a clutch plate located therebetween. A nut, threaded onto the bushing, provides an adjustable force through a spring washer to control the force of the friction washers against the clutch plate. The bushing is removably mounted to a shaft so that it rotates with the shaft while the clutch plate is held stationary. The torque required to rotate the shaft is controlled by adjusting the nut on the threaded end of the bushing.

21 Claims, 3 Drawing Figures

MINIATURE ADJUSTABLE POTENTIOMETER CLUTCH

BACKGROUND OF THE INVENTION

The present invention relates to a torque adjusting apparatus and more particularly to a removable clutching mechanism for varying the torque required to turn a rotatable shaft.

In many instrument systems, conventional knobs are used to control various functions to the system. Such knobs are coupled through rotating shafts to control individual elements including switches, gear trains, potentiometers, indicators, and a variety of other elements. These elements are used in all types of instrument systems including avionics systems located in the cockpit of an aircraft. Normally, the torque required to turn the knobs is fixed by the particle construction of each of the individual elements and cannot be independently and variably adjusted. This means that the torque required to operate the shaft of any element is usually set by the manufacturer and varies greatly between individual elements and manufacturers of those elements.

In avionics systems particularly, the instruments located in the cockpit of an aircraft are usually confined to a limited area for easy access by the pilot and other cockpit personnel. The space limitations for such systems requires multi-function instruments which often include numerous knobs and switches in a very small area. Experience has shown that proper operation of the instruments is often dependent upon the tactile characteristics of the various knobs and switches. The right "feel" of those knobs and switches will thus affect the correct and efficient operation of the individual elements which they control. The torque on the shaft turned by such knobs is one of the tactile characteristics which contributes to the proper "feel" during operation. Naturally, the proper torque will significantly vary between operators and can therefore not be preset when various operators are using the same devices. The predetermined torque settings of conventional elements are therefore incapable of meeting individual operator preferences.

In the crowded cockpit environment, an additional problem encountered is that of inadvertent bumping or turning of adjacent knobs when the primary knob is being rotated. If the torque required to turn an adjacent knob is insufficient, a slight bump or brush may cause significant turning of the adjacent knob thereby destroying the setting of its element. In avionics systems particularly, the prevention of such inadvertent movement may be critical in preventing improper aircraft flight control as well as in preventing waste of pilot or operator time for resetting bumped or jarred knobs. With the preset element torques, greater care is required to prevent inadvertent rotation thereby taking up critical operator time, especially in busy flight environments.

Various techniques have been proposed to overcome the above problems. Some of those techniques have used spring and clutch arrangements which provide a force against the rotating shaft to increase the torque required to turn it. In most cases, such devices are designed to provide a one-time increase in the torque required to turn the shafts and thus are incapable of being adjusted. Over the course of time, wear on the shaft or clutch elements changes the torque required to turn the shaft so that the above problems are again encountered. The elements must then be repaired with the attendent expense increasing the life-cycle costs of the instruments.

In other instances, conventional devices are unacceptable because of the need for torque adjusting elements of small size. In avionics systems particularly, the constraints of the cockpit make it essential that miniaturization of elements be accomplished if at all possible. Prior devices have been complex and cumbersome and not suitable for cockpit use.

Accordingly, the present invention has been developed to overcome the shortcomings of the above known and similar techniques and to provide an improved clutch mechanism for variably controlling the torque required to turn a rotatable shaft.

SUMMARY OF THE INVENTION

In accordance with the present invention, a clutch mechanism is constructed for removable attachment to rotatable shafts. A generally cylindrical bushing is formed to have an axial opening extending the length of the bushing and configured to be removably positioned about a rotatable shaft. One end of the bushing is threaded while the opposite end has a circumferential flange and a means for retaining the bushing in a stationary position on the shaft for rotation therewith. A pair of friction washers sandwich a clutch plate and are slidably received over the bushing so that the rear face of one washer abuts against the circumferential flange. A nut threaded onto the opposite end of the bushing retains a spring washer against the rear surface of the other friction washer to adjust the force applied by the washers against the clutch plate. The clutch plate is held stationary by a support plate used to mount the device to which the shaft is attached and thus provides a friction surface which increases the torque required to turn the shaft and bushing. The magnitude of the torque can be varied by rotation of the nut which changes the force applied through the spring washer to the friction washers.

It is therefore a feature of the present invention to provide a simple and inexpensive apparatus for changing the torque required to turn a rotatable shaft.

It is further feature of the invention to provide a removable clutch mechanism for adjusting the torque required to turn a rotatable shaft.

Still another feature of the invention is to provide a removable adjustable clutch mechanism which allows easy change of the tactile characteristics of elements including rotating shafts.

Still another feature of the invention is to provide an adjustable clutch mechanism which may be constructed of small size for removable attachment in limited space.

Yet another feature of the invention is to provide an adjustable clutch mechanism for changing the torque required to turn a rotatable shaft without wearing the shaft or instrument element.

Still another feature of the invention is to provide an adjustable clutch mechanism which can vary the torque required to turn a rotatable shaft over a wide range.

These and other novel features of the present invention will become apparent from the following detailed description when taken in connection with the accompanying drawings wherein:

DETAILED DESCRIPTION OF A PREFERRED EMBODIMENT

Figure 1:
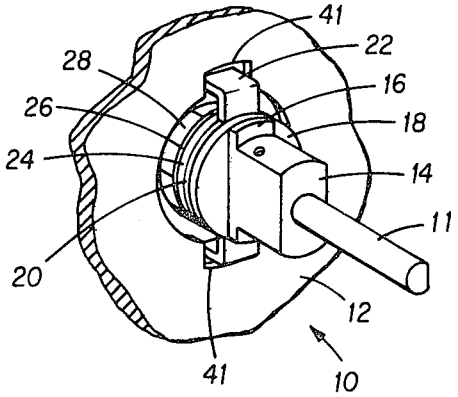
FIG. 1 is a perspective view of the adjustable clutch mechanism showing its location with respect to mounting on a shaft and support plate.

Referring now to the drawings wherein like numerals are used to identify like elements throughout, the adjustable clutch mechanism is shown removably coupled about shaft 11 and retained by mounting plate 12. The shaft 11 may be part of any individual control device such as a potentiometer, rotary switch or other similar element which is mounted on an instrument panel forming a mounting plate 12 so that the shaft extends outward to receive a control knob (not shown). Naturally, the panel 12 may be part of any instrument or other device and may include numerous closely mounted elements as previously noted. Use of the clutching mechanism 10 is not restricted to any particular element or instrument, nor by the particular configuration of the shaft on which it is mounted.

Figure 2:
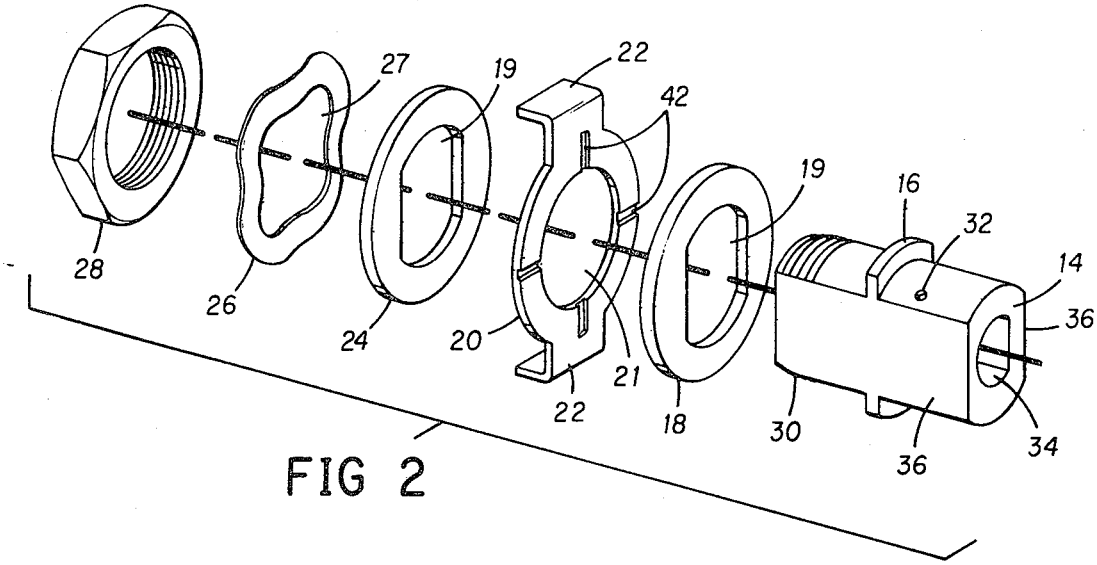
FIG. 2 is an exploded perspective view showing each of the individual elements of the clutch mechanism.

As shown in FIGS. 1 and 2, the clutching mechanism includes a generally cylindrical bushing or body element 14 having an axial opening 34. The bushing may be formed of any material having sufficient structural strength to accommodate reliable operation in its intended environment. In the present instance, the bushing 14 is formed by machining a brass alloy metal blank to the configuration which will be described. The axial opening 34 is machined to conform to the outside configuration of the shaft 11. The opening 34 may be cylindrical throughout its length or any other configuration designed to slidably receive shaft 11.

In the present example, as shown in FIG. 2, the opening 34 has a portion located at one end which has a conventional D-shaped cross-sectional configuration which mates with a corresponding D-shaped portion on the shaft 11. This configuration is designed to rigidly retain the bushing 14 for movement with the shaft 11. The bushing 14 is machined to have opposed flat parallel faces 36 extending symmetrically about and along the axis of opening 34 for the length of the bushing 14. The bushing 14 is also machined to have a flange 16 which extends radially from the cylindrical circumference of those portions of the bushing 14 located between the flat faces 36. The flanges 16 are symmetrically positioned about the axis of the opening 34 to form flat faces substantially perpendicular to the axis of opening 34.

A friction washer 18 is slidably received by the bushing 14 through opening 19 which is formed to have the same configuration as the outer circumference of the bushing 14. In the present example, the washer 18 is circular and has two opposed flat friction surfaces one of which abuts the surface of the flanges 16 when the washer is received by the bushing 14. The washer may be made of any suitable material designed to provide high wear characteristics when subjected to movement against an adjacent surface. In the present example, the washer 18 is made of machined steel, but other suitable long-wearing materials could be used without restricting the scope of the invention.

A clutch plate 20 having opposed and substantially parallel, flat friction surfaces is slidably received over the bushing 14 and abuts the other surface of the washer 18. The clutch plate 20 is formed to have an opening 21 which in the present instance is a circular opening allowing the bushing 14 to be freely rotated within the opening 21. The opening 21, however, is so configured that it prevents any substantial movement of the clutch plate 20 along a line perpendicular to that axis. In this manner the clutch plate is positioned so that the face of the washer 18 will uniformly engage the face of the clutch plate 20 when forces are applied to the washer and clutch plate parallel to the axis of opening 34.

A second friction washer 24 of identical construction to the washer 18 slidably receives bushing 14 through its opening 19. A spring washer 26 is received by the bushing 14 through opening 27 and bears against one of the flat surfaces of friction washer 24. The opening 27 is formed to allow the bushing 14 to freely rotate within the opening 27 as was described with respect to opening 21. The washer 26 is also constructed as a conventional wave or similar spring-type washer and is made of a high tensile material sufficient to maintain the spring resiliency. A nut 28 is threadably received by the bushing 14 on threaded end portion 30 and acts to retain each of the members 18, 20, 24, and 26 in forced abutting relationship between the nut and the faces of the flanges 16.

Figure 3:
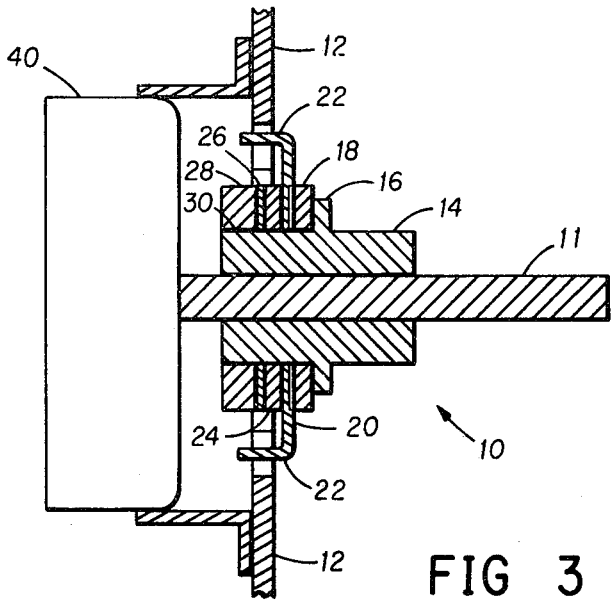
FIG. 3 is a side sectional view showing the clutch mechanism mounted on the shaft of an element.

As shown in FIG. 1, the clutch plate 20 also includes opposed extending L-shaped projections 22 which are designed to engage indents 41 in mounting plate 12 (fixed member). As may be easily seen in FIG. 3, the projections 22 have a portion which extends generally parallel to the axis 34 and are of a length which extends substantially to the end of the bushing 14 on the threaded end 30. The clutch plate 20 also includes U-shaped channels 42 machined on both surfaces of the clutch plate 20 and extending generally perpendicular to the axis 34. These channels are formed to be substantially of uniform depth and radially spaced about the surface of clutch plate 20. In the present instance, four channels are shown spaced ninety degrees apart about each face of the clutch plate but it is apparent that the number and spacing of the channels may be varied without detracting from the teachings of this invention. The channels are used to increase the uniformity in the frictional engagement between the faces of the washers 18 and 24 and the faces of the clutch plate 20. The channels 42 also increase the wear properties of the assembly.

The operation of the device as a means of providing a variable torque resistive to shaft movement is apparent from each of the drawings. Specifically, as the nut 28 is threaded on bushing 14 against spring washer 26, it produces a force parallel to the axis of opening 34 which is transmitted through spring washer 26 and thence to washer 24 and clutch plate 20. The force produced by the nut 28 maintains the opposed faces of clutch plate 20 in sliding frictional engagement with the faces of washers 18 and 24 when bushing 14 is rotated with shaft 11. The force with which the washers 18 and 24 are retained against the faces of the plate 20 determines the magnitude of friction between the faces and thus determines the amount of torque necessary to rotate the shaft 11. By moving the nut 28 on the threaded portion 30, the force produced by the spring washer 26 can be varied from substantially no friction to a substantially locked position where the shaft 11 cannot be turned. Naturally the variation between the two force extremes and the adjustability is determined by thread pitch 30 and the spring value of the washer 26. In operation, however, the nut can be rotated to change the forces causing the frictional engagement of washers 18 and 24 and thus easily change the torque required to turn the shaft 11. The bushing 14 may include an opening 32 extending from the surface of bushing 14 into opening 34 and threaded to receive a set screw or similar retaining element to engage the shaft 11 and retain the bushing at a predetermined position on the shaft 11.

As can be seen from the above description, the adjustable clutch mechanism can be used to provide an essentially infinite adjustment of torque values for controlling the force required to turn shaft 11. The construction of the device with conventional materials allows low-cost manufacture and low-cost maintenance and repair. The simplicity of the structure facilitates its miniaturization for easy insertion and removal about the shaft of various devices in small and crowded environments. The arrangement of the friction washers about clutch plate 20 causes wear to occur only on the faces of the washers 18, 24 and clutch plate 20 rather than on the shaft of the individual element with which it is used. Such wear does not change the torque significantly and, in any event, the nut can be easily adjusted to restore the desired torque if changes occur because of wear. If washers 18 and 24 and the clutch plate 20 become worn to a point where they can no longer be used, they may be easily replaced without the expense of replacing the instrument element itself. Because the spring 26 does not abut a rubbing surface, the force provided by the nut 28 will be held constant and there will be no self-loosening during the rotation of the bushing 14. Because the clutch mechanism may be easily inserted on each of many shafts in a small area, individual torque settings are easily attained on a variety of different shafts. These are all advantages and features which are not taught or shown by the prior art.

While the invention has been described with reference to particular bushing and washer configurations, it is evident that other configurations could be used without departing from the inventive teachings. In particular, the bushing 14 could be retained on shaft 11 by a key/slot arrangement in lieu of the D-configuration of the opening 34. Likewise the washers 18 and 24 could have openings 19 formed of a different configuration so long as it mates with the circumferential configuration of the bushing 14 to cause movement of the washers. Other methods of coupling the washers for movement with the bushing could also be used in lieu of the specifically described openings 19. The projections 22 could also be replaced with other configurations designed to be attached or retained by the support plate to prevent clutch plate movement.

Obviously, many other modifications and variations of the present invention are possible in light of the above teachings. It is therefore to be understood that within the scope of the appended claims the invention may be practiced otherwise than as specifically described.

What is claimed is:

1. An apparatus for controlling the torque required to move a rotatable member comprising:

means for forming a body element having an axial opening therethrough extending along an axis, said body element being rotatable about said axis;

at least one first friction means coupled to said body element for rotational movement therewith and having a first friction surface;

second friction means coupled about the body element for providing at least one second friction surface positioned adjacent said first friction surface, said second friction means including means for engaging a fixed member to maintain said second friction means stationary so that there is relative rotational movement between said first friction surface and said second friction surface during rotation of said body element; and means coupled to said body element for adjustably positioning said first friction surface and said at least one second friction surface in forceful frictional contact to adjustably vary the torque needed to rotate said body element.

2. The apparatus of claim 1 wherein said at least one first friction means comprises a flat member having opposed and substantially parallel faces positioned perpendicular to the axis of the opening through said body element.

3. The apparatus of claim 2 wherein said second friction means comprises a flat member having opposed and substantially parallel faces and an opening for receiving said body element, said opening in said second friction means being configured to position the faces of said second friction means so that they are substantially perpendicular to the axis of the opening through said body element while allowing free rotation of the body element therein.

4. The apparatus of claim 1 wherein said at least one first friction means includes two friction means each forming a first friction surface and further wherein said second friction means includes two friction surfaces, each of said first friction means being coupled to said body element for rotation therewith and for frictional engagement with a different one of the friction surfaces of said second friction means.

5. An apparatus for controlling the torque required to move a rotatable member comprising:

bushing means for forming a body element having an axial opening extending therethrough, said bushing means being rotatable about said axis;

at least one first friction means received by and surrounding said bushing means and coupled for rotational movement therewith for providing a first friction surface;

second friction means received by and surrounding said bushing means for providing at least one second friction surface adjacent said first friction surface, said second friction means being constructed so that said bushing means may rotate freely with respect thereto, said second friction means further including a means for engaging a fixed member to maintain said second friction means stationary so that there is relative rotational movement between said first friction surface and said second friction surface during rotation of said bushing means; and means coupled to said bushing means for adjustably positioning said first friction surface and said at least one second friction surface in forceful frictional contact to adjustably vary the torque needed to rotate said bushing means.

6. The apparatus of claim 5 wherein said friction means comprises a flat member having opposed substantially parallel faces positioned substantially perpendicular to the axis of the opening through said bushing means and further wherein said at least one friction means comprises two washers positioned on either side of said second friction means so that one surface of each washer is adjacent a different face of said flat member.

7. The apparatus of claim 5 wherein said means for adjustably positioning comprises a spring washer received by said bushing means and a nut threadably received by one end of said bushing means, said nut engaging said spring washer during rotation so that it causes the application of force through said spring washer to move the faces of said first friction surface into frictional contact with said second friction surface.

8. The apparatus of claim 5 wherein said first friction means comprises two circular washers and said second friction means comprises a circular clutch plate sandwiched therebetween.

9. An apparatus for controlling the torque required to move a rotatable member comprising:

a generally cylindrical bushing having an axial opening extending the length thereof, said bushing having two opposed flat faces symmetrically spaced about and parallel to said axial opening on the circumference of said bushing and opposed flanges radially extending from one end of said bushing, each having a face perpendicular to the axis of said opening;

a first flat washer having an opening conforming to the circumference of said bushing and received by and positioned over said circumference so that one surface of the washer abuts the faces of the flanges;

a clutch plate having opposed substantially parallel surfaces and a circular opening receiving the circumference of the bushing to position the clutch plate so that one face is adjacent said first washer while allowing rotation of the bushing within the opening of said clutch plate;

a second washer of substantially identical construction to said first washer and positioned about said bushing so that one surface is positioned adjacent the other surface of said clutch plate;

a spring washer received about the circumference of said bushing and positioned adjacent the other surface of said second washer; and a nut threaded onto the other end of said bushing and adjacent said spring washer for applying a force against said spring washer parallel to the axis of said bushing.

10. The apparatus of claim 9 wherein said clutch plate and said first and second washers are circular and said washers have an outside diameter smaller than the outside diameter of said clutch plate.

11. The apparatus of claim 9 wherein said clutch plate further includes a plurality of channels in each surface of the clutch plate radially spaced about the opening in said plate.

12. The apparatus of claim 10 wherein said clutch plate includes at least one L-shaped projection radially extending from an edge of said clutch plate so that one portion of the projection extends parallel to the axis of said opening.

13. In an apparatus having a variable element and a rotatable shaft coupled to control said variable element, the improvement comprising a means for controlling the torque required to rotate said shaft including:

means for forming a body element having an axial opening for receiving said shaft;

means for securing said body element to said shaft so that said body element rotates with said shaft;

at least one friction means received by said body element and coupled for rotational movement therewith for providing a first friction surface;

second friction means coupled about said body element for providing at least one second friction surface positioned adjacent said first friction surface;

means for engaging a fixed member to maintain said second friction means stationary so that there is relative rotational movement between said first friction surface and said second friction surface during rotation of said body element; and means coupled to said body element for adjustably positioning said first friction surface and said at least one second friction surface in forceful frictional contact to adjustably vary the torque needed to rotate said body element.

14. The apparatus of claim 13 further including means in said body element for securing said body element at a fixed position along the length of said shaft.

15. The apparatus of claim 13 wherein said at least one first friction means includes two first friction means each forming a first friction surface and further wherein said second friction means includes two friction surfaces, each of said first friction means being coupled to said body element for rotation therewith and for frictional engagement with a different one of the friction surfaces of said second friction means.

16. The apparatus of claim 15 wherein each of said first friction means comprises a flat washer having opposed and substantially parallel faces positioned perpendicular to the axis of the opening through said body element.

17. The apparatus of claim 16 wherein said second friction means comprises a flat member having opposed and substantially parallel faces and an opening for receiving said body element, said opening in said second friction means being configured to position the faces of said second friction means so that they are substantially perpendicular to the axis of the opening through said body element while allowing free rotation of the body element therein.

18. The apparatus of claim 15 wherein said first friction means comprises two circular washers and said second friction means comprises a circular clutch plate sandwiched therebetween.

19. The apparatus of claim 18 wherein said means for adjustably positioning comprises a spring washer received by said body element and a nut threadably received by one end of said body element, said nut engaging said spring washer during rotation so that it causes the application of force through said spring washer to move the faces of said two circular washers into frictional engagement with the faces of said clutch plate.

20. The apparatus of claim 18 wherein said clutch plate further includes a plurality of channels in each surface of the clutch plate radially spaced about the opening in said plate.

21. The apparatus of claim 18 wherein said body element is generally formed as a cylindrical bushing with the axial opening extending the length thereof, said bushing having two opposed flat faces symmetrically spaced about and parallel to said axial opening on the circumference of said bushing and opposed flanges radially extending from one end of said bushing, each having a face perpendicular to the axis of said opening.

* * * * *